US012369663B2

(12) United States Patent
Hollander et al.

(10) Patent No.: US 12,369,663 B2
(45) Date of Patent: Jul. 29, 2025

(54) BELT TIGHTENING SYSTEM

(71) Applicants: Kevin Hollander, Scottsdale, AZ (US); Darren Kinney, Phoenix, AZ (US)

(72) Inventors: Kevin Hollander, Scottsdale, AZ (US); Darren Kinney, Phoenix, AZ (US)

( * ) Notice: Subject to any disclaimer, the term of this patent is extended or adjusted under 35 U.S.C. 154(b) by 0 days.

(21) Appl. No.: 18/515,686

(22) Filed: Nov. 21, 2023

(65) Prior Publication Data

US 2024/0164461 A1 May 23, 2024

Related U.S. Application Data

(60) Provisional application No. 63/427,375, filed on Nov. 22, 2022.

(51) Int. Cl.
*A41F 9/02* (2006.01)

(52) U.S. Cl.
CPC ..... *A41F 9/025* (2013.01)

(58) Field of Classification Search
None
See application file for complete search history.

(56) References Cited

U.S. PATENT DOCUMENTS

| | | | | |
|---|---|---|---|---|
| 181,155 | A * | 8/1876 | Eager | A41F 9/02 2/237 |
| 2,618,784 | A * | 11/1952 | Root | A41D 1/21 2/221 |
| 2,905,948 | A * | 9/1959 | Grisanti | A41F 9/025 2/338 |
| 3,940,801 | A * | 3/1976 | Riggs | A41F 9/005 2/311 |
| 11,998,065 | B2 * | 6/2024 | Gladney | A41F 9/025 |
| 2010/0139057 | A1 * | 6/2010 | Soderberg | A63C 10/06 242/396.2 |
| 2019/0021423 | A1 * | 1/2019 | Fayle | A41F 9/025 |
| 2020/0378040 | A1 * | 12/2020 | Aleman | D03D 3/005 |
| 2021/0259327 | A1 * | 8/2021 | Gladney | A41F 9/025 |
| 2022/0160065 | A1 * | 5/2022 | Pagano | A45C 1/04 |

* cited by examiner

*Primary Examiner* — Bao-Thieu L Nguyen
(74) *Attorney, Agent, or Firm* — Accelerate IP LLC

(57) ABSTRACT

A belt system that includes an elongated strap extending between a first and second end, with a first fastener coupled to the first end and a second fastener coupled to the second end. The belt system also includes at least one adjustable length cable coupled near the first end and the second end. The cable passes through the strap at multiple pass-through points, allowing the strap to be cinched and the belt to be shortened by adjusting the cable length. The cable length can be adjusted by a dial located on the first fastener or by a cincher fixed near the first fastener, which includes a housing supporting a dowel to which the cable end is secured. The dowel can rotate in two directions, and the cincher includes a gear, a cam, and a release that allows a user to selectively disengage the cam from the gear to release the wire.

11 Claims, 3 Drawing Sheets

BELT TIGHTENING SYSTEM

CROSS REFERENCE

This application claims benefit from currently U.S. Provisional Application No. 63/427,375 titled "Belt Tightening System" and having a filing date of Nov. 22, 2022, and all of which is incorporated by reference herein.

FIELD OF THE INVENTION

The present specification relates to a new and improved belt system, more particularly a belt that uses a tightening mechanism that makes fine adjustments and evenly distributes the force around the user's limbs or waist.

BACKGROUND OF THE INVENTION

Current belts that exist in the art have a wide variety of applications including but not limited to, keeping pants from falling down, backpack support, exoskeleton support, or applying a tourniquet to a limb. Belts usually have a buckle, strap and through-points within the strap that the prong on the buckle fits into. These types of belts are limited in only allowing the user to have large adjustment sizes because of the spacing of the through-points that are on the straps. So, individuals have developed belts where the back of the strap has multiple angled recesses running the length of the belt strap. This type of belt has a buckle with a spring-loaded pin that catches on the angle recess keeping the belt in place and tight. The recesses within the strap have a set spacing which can be large or small allowing the user to adjust the belt only for the set spacing of the recesses.

The forces provided by these types of belts around the user's limb has a pulling force in the direction of the belt's buckle creating inconsistent pressure around the user's limb. The belt, buckle and through-points that are on the strap only allow for minimum adjustability. Additionally, individuals have different body shapes and figures which can be problematic because a one size fits all solution is not feasible for belts. Traditional or conventional belts cannot always be adjusted properly to allow micro adjustments and to allow for comfort while wearing clothing, a robotic device, or any other device that requires a belt.

Therefore, there is a need for a belt that allows the user to make micro-adjustments within the belt that creates a constant force around the user's torso, waist or limb.

BRIEF SUMMARY OF THE INVENTION

The present invention provides a belt system that is easily adjustable and secure. The objective of this invention is to introduce a belt system that offers enhanced adjustability and secure fastening. The invention aims to provide a belt system that is easy to adjust in length and simple to fasten and unfasten, while ensuring a secure fit. A further objective of the invention is to provide a belt system that incorporates an adjustable length cable, which passes through the strap at multiple pass-through points. This unique feature allows the user to shorten the belt by cinching the strap between the pass-through points, providing a high level of adjustability and comfort.

Another aim of the invention is to provide a belt system that utilizes a slip-on buckle as the first fastener. This buckle is designed for quick release, featuring a male end and a female end, where the female end can be removably locked into the male end, ensuring a secure yet easily removable connection. The invention also aims to provide a belt system that includes a cincher near the first fastener. This cincher comprises a housing supporting a dowel to which the cable end is secured. The length of the cable can be adjusted by rotating the dowel, providing an additional level of adjustability to the belt system.

The invention further aims to provide a belt system where the cable length can be adjusted by a dial located on the first fastener. The cable is spooled about when the dial is rotated, allowing for easy and precise adjustments to the belt length. The invention also aims to provide a strap tightener for a strap that extends a length between a first end and second end. The tightener includes a housing supporting a dowel that rotates in two directions, a gear coupled to the dowel, a cam coupled to the housing that is spring biased to engage the gear, and a release that allows a user to selectively disengage the cam from the gear. This mechanism allows for easy tightening and loosening of the strap, enhancing the user's comfort and convenience.

Lastly, the invention aims to provide a belt system where the strap is made of nylon webbing, offering durability and flexibility, and where the dowel is detachably coupled to the strap via a slot or a t-shaped slot, providing a secure yet easily adjustable connection. The housing may also have a slot through which the strap is passed.

It is an objective of the invention to allow a user to adjust and tightening a belt with micro settings creating a precision fit around a user's torso, waist or limb.

It is an objective of the invention to apply a load evenly across the whole belt.

It is an objective of the invention to be easily attached and released to the user.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the. Absent such clear statements of intent to apply a "special" definition, it is the inventor's intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for" and will also recite the word "function" (i.e., will state "means for performing the function of . . . , without also reciting in such phrases any structure, material or act in support of the function. Thus, even when the claims recite a "means for performing the function of molding a . . . , step for performing the function of molding a . . . ," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

Additional features and advantages of the present specification will become apparent to those skilled in the art upon consideration of the following detailed description of the illustrative embodiment exemplifying the best mode of carrying out the invention as presently perceived.

BRIEF DESCRIPTION OF THE DRAWINGS

These and other features, aspects, and advantages of the present specification will become better understood with regard to the following description, appended claims, and accompanying drawings where:

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1:
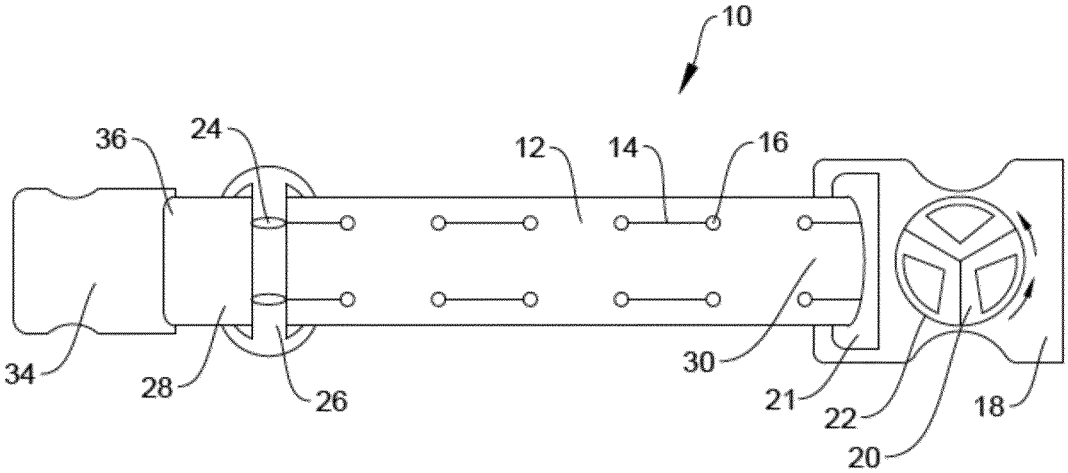
FIG. 1 is a top view of exemplary embodiment of a belt system in accordance to one, or more embodiments.

Referring initially to FIG. 1 a belt system is shown generally at 10. A belt system 10 can comprise an elongated strap 12 extending between a first end 28 and second end 30. The elongated strap 12 can be such as, for example, nylon, leather, stainless steel, canvas, or the like. The elongated strap 12 can have a set or an adjustable length that can extend between the first end 28 and the second end 30. The first end 28 can be coupled to a first fastener 34 and the second end 30 can be coupled to a second fastener 18 at location 21 configured to interact with the first fastener 34. The first and second fasteners 34, 18 can be such as, for example, a slip-on buckle, cam buckle, ratchet buckle, flip lock buckle, no sew buckle, or other fastener known to those having skill in the art. The first and second fastener 34, 18 may be secured to the first and second end 28, 30 by such as, for example, adhesive, sewing, wrap around or the like.

The strap 12 can couple to the first or second fastener 34, 18 at the first end 28 and the second end 30 wherein the strap can be adjustable by such as, for example, feed through buckles, squeeze release buckles, cam buckles, hook and loop back on itself, or the like wherein it adds another way to adjust the strap around the user or item.

At least one adjustable length cable 14 coupled near the first end 28 and the second end 30, wherein the at least one adjustable length cable passes through the strap 12 at a plurality of pass-through points 16 such that shortening the at least one cable cinches the strap between the plurality of pass-through points to shorten the belt. The at least one cable 14 can be coupled or fixed to the strap, in certain embodiments, to the first fastener 34 or the second fastener 18 at a point near the first end 28 or the second end 30 and can stretch the length or some portion of the length of the strap 12. In the preferred embodiment the cables 14 can be attached to a buckle 18 wherein the cable can wrap around the buckle when tightening the belt wherein the buckle can comprise a dial 20 that can pull and release the cable locking the cable in place wherein the dial can have an outer housing 22.

Figure 3:
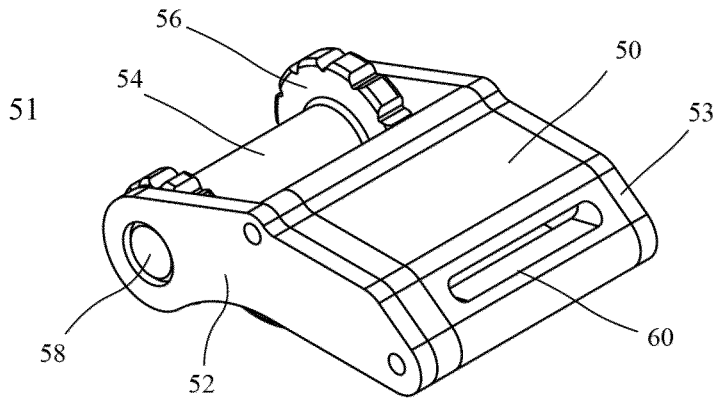
FIG. 3 is an isometric view of another embodiment of a buckle of the belt system in accordance to one, or more embodiments.

The cable 14 can be such as, for example, steel cabling, wire rope, stainless steel rope, plastic filament or the like and can be coated with an outer sheath which can be such as, for example, plastic, rubber, or the like. The plurality of pass through-points 16 extending the length of the strap can be holes with grommets or in other embodiments the through-points can extend only partially along the length of the strap. The strap 12 can have a plurality of through-points 16 evenly or in other embodiments unevenly spaced and can have at least two rows substantially near the top and the bottom of the strap. Each cable 14 can have a first cable end, the belt system 10 can further comprise a cincher 51 fixed near the first fastener 34, wherein the cincher comprises a housing 50 supporting a dowel 54 to which the first cable end of the at least one cable is secured, wherein the cable length is adjusted by rotating the dowel as shown in FIG. 3.

The cable 14 can be such as, for example, steel cabling, wire rope, stainless steel rope, plastic filament or the like and can be coated with an outer sheath such as, for example, plastic, rubber, or the like. The strap 12 can have a plurality of through-points 16 extending the length of the strap or in other embodiments the through-points can extend only partially along the length of the strap. In the preferred embodiment the strap 12 can have a plurality of through-points 16 evenly or unevenly spaced and can have at least two rows substantially near the top and the bottom of the strap.

The cable 14 can weave from the front of the strap 12 to the back of the strap 12 from the one through-point to the next through-point extending the length of the strap. In other embodiments, the cable 14 can be coupled to a second buckle 26 by at least one attachment point 24. The second buckle 26 can be removably or permanently attached to the strap 12 and can be substantially near the second end 28 of the strap or it can be at any location on the strap wherein the second buckle can couple to the strap and allow the belt to cinch from that location to the buckle 18. In certain embodiments, the strap 23 and the cable 14 can have a sheath around it extending the length the strap and cable or substantially the length of the strap and cable. The sheath can be such as, for example, leather, plastic, nylon, clothe, or the like.

The first fastener 34 and second fastener 18 can be a quick release buckle having a male end and a female end wherein the female end is removably locked into the male end. The cable 14 can be coupled to the buckle 18 wherein the buckle can comprise a housing wherein the housing can support at least one spring that pushes on a cam 64 that is rotatable within housing wherein the cam can engage a first body. The first body can have an outer body and an inner body wherein the first body is rotatably disposed in the housing wherein the inner body can have a gear around its circumference wherein the cam 64 can engage the gear locking the first body in place. The cable 14 can wrap around the inner body wherein as the user twist the first body the cam catches the gear as it rotates and locks into place tightening the belt around the user's waist or limb wherein the limb can be such as, for example, arm, leg, any portion of the body, or the like. The first body can release the cam by pushing or pulling the first body and unlocking the first body from the cam allowing the cable 14 to be pulled out by the user.

Figure 4:
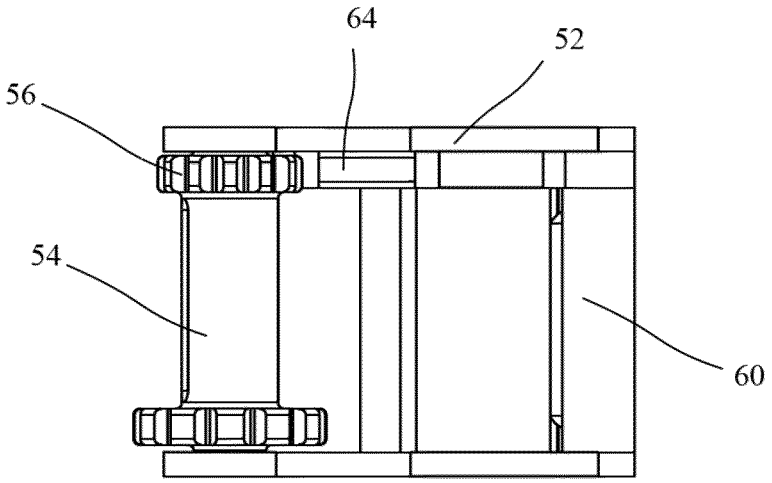
FIG. 4 is a bottom view of another embodiment of a buckle of the belt system in accordance to one, or more embodiments.
Figure 5:
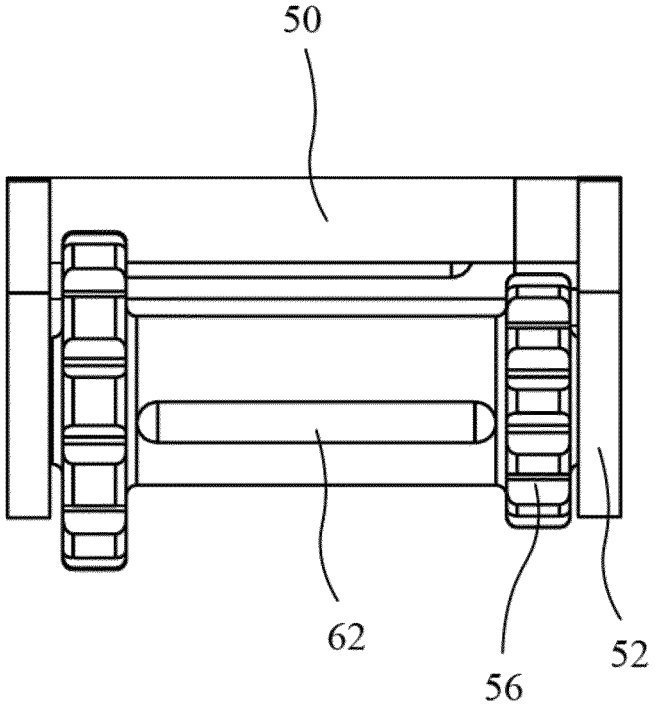
FIG. 5 is a front view of another embodiment of a buckle of the belt system in accordance to one, or more embodiments.

Referring to FIG. 3-5, in other embodiments, a belt tightener 51 is coupled to a strap having a length that extends between a first end and a second end. The tightener 51 can have a housing 50 and at least a first slot 60 wherein the strap or wire can be passed through. In other embodiments, the housing 50 may have a clamp that can be locked to the strap.

The tightener comprises a dowel 60 having a length coupled to one or more gears 56 located at least one end of the dowel. The dowel 60 can have a dowel slot substantially centered on the dowel 54 wherein a strap can be passed through the dowel and the strap can wrap around the dowel 54. The dowel 60 may rotate in a first direction and a second direction opposite to the first direction and wherein the cincher 51 can further comprises one or more gear 56 coupled to the dowl 54 and a cam 64 coupled to the housing 50 that is spring biased to engage the gear to prevent the dowel from rotation in the first direction. A release 58 can allow a user to selectively disengage the cam 64 from the gear 56 to release the cable 14 and in other embodiments a lateral motion by pushing the release 58. The cincher 51 can further comprise a pusher 58 that can allow a user to rotate the dowel 54 in the second direction. The dowl 54 can have a t-shape cutout in it.

The tightener 51 can have a first cam 64 attached to at least one side 52 of the housing 50 wherein the cam is rotatable around an axis allowing the first cam 64 to lock on the gears 56. The first cam 64 can be manually released by the pusher 58 either pushing the cam in or down releasing the cam from the gear. In certain embodiments the cam 64 can be on both sides of the housing and can engage two or more gears.

A strap tightener for a strap that extends a length between a first end and second end, the tightener comprising a housing supporting a dowel that rotates in a first direction and in a second direction opposite to the first direction, wherein the dowel is detachably coupled to the strap such that rotating the dowel in the first direction winds the strap about the dowel and shortens the length. The gear 56 can be coupled to the dowel 54. A cam 64 can be coupled to the housing 50 that is spring biased to engage the gear to prevent the dowel from rotating in the second direction. A release 58 can allows a user to selectively disengage the cam 64 from the gear to allow the dowel 54 to rotate in the second direction. The dowel 54 can be detachably coupled to the strap via a slot 62 that passes through the dowel. The dowel has a face and is detachably coupled to the strap via a t-shaped slot in the face of the dowel. The housing 50 further comprising a slot 60 through which the strap is passed.

Figure 2:
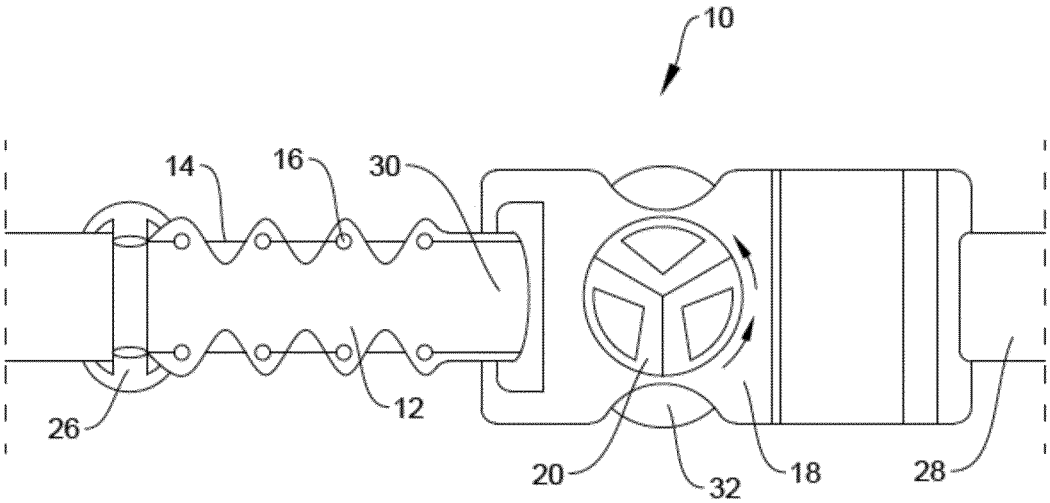
FIG. 2 is a top view of a belt system in its contracted state in accordance to one, or more embodiments.
Figure 6:
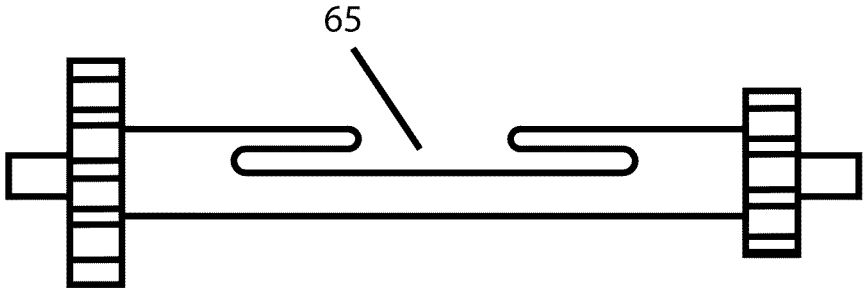
FIG. 6 is a partial front view of another embodiment of a buckle of the belt system in accordance to one, or more embodiments.

In embodiments, as the user tightens the cable 14 or the strap 12 within the buckle the cable 14 pulls on the second buckle or the second end 28 the cable cinches the strap creating an accordion effect in its contracted state and a constant force around the user's limb, torso or in areas of use that belts are used as shown in FIG. 2. The tightener 51 as shown in FIG. 6 can be place anywhere on the strap wherein the dowel 54 can have an open slit 65 allowing the buckle to be put anywhere on the strap, or belt. The belt system 10 can be used on such as, for example, pants, back packs, robotic systems, bags, tourniquets, or the like. In certain embodiments the belt system 10 can have the first buckle as shown in FIG. 1 and can apply the second buckle as shown in FIG. 3 and FIG. 6 wherein the user can adjust the belt in micro cinches and if necessary, can slip on the tightener as shown in FIG. 6 over the strap and tightening the strap. In other embodiments, the tightener as shown in FIG. 6 can fit over any location on the strap and allow the user to tighten the strap on any location on the strap.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

What is claimed is:

1. A belt system comprising:

an elongated strap extending between a first end and second end;

a first fastener coupled to the first end and a second fastener coupled to the second end;

at least one adjustable length cable having a first cable end and coupled near the first end and the second end, wherein the at least one adjustable length cable passes through the strap at a plurality of pass-through points such that shortening the at least one cable cinches the strap between the plurality of pass-through points to shorten the belt;

a cincher fixed near the first fastener, wherein the cincher comprises a housing supporting a dowel to which the first cable end of the at least one adjustable length cable is secured, wherein the cable length is adjusted by rotating the dowel.

2. The belt system according to claim 1, wherein the through-point is a hole and wherein the cable weaves from the one hole to the hole.

3. The belt system according to claim 1, wherein the first fastener is a slip-on buckle.

4. The belt system according to claim 1, wherein the strap is nylon webbing.

5. The belt system according to claim 3, wherein the slip-on buckle is a quick release having a male end and a female end wherein the female end is removably locked into the male end.

6. The belt system according to claim 1 wherein the at least one adjustable length cable is adjusted by a dial located on the first fastener.

7. The belt system according to claim 6 wherein the at least one adjustable length cable is spooled about the when the dial is rotated in a first direction.

8. The belt system according to claim 1, wherein the dowel may rotate in a first direction and a second direction opposite to the first direction, and wherein the cincher further comprises:

a gear coupled to the dowel;

a cam coupled to the housing that is spring biased to engage the gear to prevent the dowel from rotating in the first direction;

a release that allows a user to selectively disengage the cam from the gear to release the wire.

9. The belt system according to claim 1, wherein the housing has a first slot through which the at least one adjustable cable is passed.

10. The belt system according to claim 6, wherein the cincher further comprises a pusher that allows a user to rotate the dowel in the second direction.

11. The belt system according to claim 9, wherein the dowel has a cutout having a cutout slot in the dowel.

* * * * *